US011149362B2

(12) United States Patent
Ueda et al.

(10) Patent No.: US 11,149,362 B2
(45) Date of Patent: Oct. 19, 2021

(54) INDUSTRIAL TWO-LAYER FABRIC

(71) Applicant: NIPPON FILCON CO., LTD., Tokyo (JP)

(72) Inventors: Ikuo Ueda, Shizuoka (JP); Teppei Hashiguchi, Shizuoka (JP); Akira Tajima, Shizuoka (JP)

(73) Assignee: NIPPON FILCON CO., LTD., Inagi (JP)

( * ) Notice: Subject to any disclaimer, the term of this patent is extended or adjusted under 35 U.S.C. 154(b) by 0 days.

(21) Appl. No.: 16/313,800

(22) PCT Filed: Jan. 26, 2017

(86) PCT No.: PCT/JP2017/002721
§ 371 (c)(1),
(2) Date: Dec. 27, 2018

(87) PCT Pub. No.: WO2018/138827
PCT Pub. Date: Aug. 2, 2018

(65) Prior Publication Data

US 2019/0153633 A1 May 23, 2019

(51) Int. Cl.
*D03D 11/00* (2006.01)
*D03D 15/65* (2021.01)
(Continued)

(52) U.S. Cl.
CPC ..... *D03D 11/00* (2013.01); *D03D 15/65* (2021.01); *D21F 1/0045* (2013.01); *D21F 1/10* (2013.01)

(58) Field of Classification Search
CPC .. D03D 11/00; D03D 15/0072; D21F 1/0045; D21F 1/10
See application file for complete search history.

(56) References Cited

U.S. PATENT DOCUMENTS 4,071,050 A * 1/1978 Codorniu ..... D21F 1/0036 139/383 A
5,829,489 A * 11/1998 Kuji ..... D21F 1/0036 139/383 A
(Continued)

FOREIGN PATENT DOCUMENTS

CN 106255779 A 12/2016
EP 0 672 782 A1 9/1995
(Continued)

OTHER PUBLICATIONS

Extended Search Report issued in European Application No. 17893956.7, dated Aug. 6, 2019.
(Continued)

*Primary Examiner* — Khoa D Huynh
*Assistant Examiner* — Erick I Lopez
(74) *Attorney, Agent, or Firm* — Michael Best & Friedrich LLP

(57) ABSTRACT

TECHNICAL PROBLEMS TO BE SOLVED BY PRESENT INVENTION The object of the present invention is to provide the industrial two-layer fabric which can make papers to be made with a lateral strength higher than that of the fabric constituted by one kind of the conventional upper surface side yarns structure by overcoming the technical difficulty in the adjustment of the fiber orientation due to the complicated factors such as a turbulence generated in the jet stream, the control of the ration J/W, etc.
MEANS TO SOLVE TECHNICAL PROBLEMS In the industrial two-layer fabric comprising an upper surface side fabric consisting of upper surface side warps and upper surface side wefts and a lower surface side fabric consisting of lower surface side warps and lower surface side wefts, the upper and lower surface side fabric being bound by foundation binding yarns, all structure portions of the upper surface side warps among a structure constituting said upper
(Continued)

surface side fabric are the same, said upper surface side wefts comprises first upper surface side wefts and second upper surface side wefts, structures forming the first upper surface side wefts are different from those forming the second upper surface side wefts.

16 Claims, 11 Drawing Sheets

(51) Int. Cl.
*D21F 1/00* (2006.01)
*D21F 1/10* (2006.01)

(56) References Cited

U.S. PATENT DOCUMENTS

2003/0024590 A1 2/2003 Stone
2005/0103397 A1* 5/2005 Quigley ..... D21F 1/0045 139/383 A
2008/0035231 A1* 2/2008 Hay ..... D21F 1/0045 139/420 B
2013/0284305 A1 10/2013 Ueda et al.
2015/0203994 A1* 7/2015 Egawa ..... D21F 1/0045 442/203

FOREIGN PATENT DOCUMENTS

JP H11-158791 A 6/1999
JP H11-158791 A 6/1999
JP 2000-144597 A 5/2000
JP 2001-192992 A 7/2001
JP 2013-213286 A 10/2013
JP 2013-227701 A 11/2013
WO 2014-104065 A1 7/2014
WO WO-2014/104065 A1 7/2014

OTHER PUBLICATIONS

International Search Report issued in Application No. PCT/JP2017/002721, dated Apr. 18, 2017.
Office Action issued in Chinese Application No. 200580011216.7, dated Oct. 10, 2020.
Article 94(3) EPC communication issued in European Application No. 17 893 958.7, dated Nov. 11, 2020.
Office Action issued in Japanese Application No. 2017-550777, dated Jan. 5, 2021.

* cited by examiner

INDUSTRIAL TWO-LAYER FABRIC

TECHNICAL FIELD OF THE INVENTION

The present invention relates to an industrial two-layer fabric which is capable of providing papers to be made with a constant fiber orientation, in particular, relates to the industrial two-layer fabric which is capable of improving the fiber orientation by means of a wire structure.

BACKGOUND ART

Fabrics obtained by weaving warps and wefts have conventionally been used widely as an industrial fabric. They are, for example, used in various fields including papermaking fabrics, conveyer belts, filtering cloth, etc., and a fiber property suitable for their applications and an environment in which they are used is demanded. In particular, the demanded property for the fabric for making papers used in a paper making process in which the material is dehydrated via a network of the fabric, for instance, is very severe.

As to such required properties for the fabric, the surface smoothness by which the wire mark of the fabric is not easily transferred to the pater supported by the fabric, the dehydration property by which excess water contained in the material is sufficiently and uniformly dehydrated, the rigidity and the wear resistance so as to be suitably used in a severe environment, and the property for maintaining the required conditions for excellent papers for a long time are required.

In addition, the fiber supportability, the improvement of the yield of the product papers, the dimension stability, and the running stability, etc., are required. Further, the required property for the fabric for making papers has become further severe in recent years, due to the high speed operation of the paper making machines.

On the other hand, in the papers as products, a technology in which the fiber strength in a predetermined direction of the papers can be improved by adjusting the fiber orientation is widely known. More specifically, such a technology includes the technique in which the fiber orientation is intentionally provided in the longitudinal or the lateral direction of the papers, depending on the applications of the papers. This causes the strength in the predetermined direction of the papers to be improved. For instance, in a case where the papers are used for newspapers, it is preferred that the strength in the longitudinal direction (feeding direction) relative to a rotary press be improved, since a large tension stress can be generated on the papers in a case where the papers are fed toward for printing.

In such a case, the papers attaining the required properties can be obtained by setting the fiber orientation to be along the longitudinal direction of the continuously rolled out original fabric for papers.

In addition, many commodities such as tissue papers, kitchen papers which are housed in a dedicated box and desired number of papers are pulled to take out of the box has been sold.

In such papers for a particular application, it becomes possible to make the tear of the papers difficult upon their taking -out if the fiber orientation is set to be along the direction which the papers are pulled while the papers are housed in the dedicated box, in advance, since the papers can be pulled out of the box in the fiber orientation.

Such being the case, a technology by which a desired fiber orientation is set on the papers has been adopted at present. In order to increase the strength in the longitudinal direction of the papers, it is considered to be effective to increase the rate of the fiber orientation to the longitudinal direction of the papers. Likewise, in order to increase the strength of the paper in the lateral direction, the rate of the fiber orientation in the lateral direction of the paper may be increased.

The adjustment of the fiber orientation is conducted by setting the difference between the feeding speed of the fiber material and the running speed of the wire when the fiber material (pulp suspension before it is used for making papers is fed from a head box toward the wire running at a high speed.

More specifically, the fiber orientation of the papers is controlled by the rate of jet(J)/wire(W). Here, jet(J) is defined to be a feeding speed at which the fiber material is fed toward the paper making machine, and wire(W) is defined to be a running speed at which the wire for the industrial fabric of the paper making machine is run.

More specifically, the rate of the fiber orientation in the longitudinal direction can be increased to improve the longitudinal strength of the papers by setting the machine to make jet(J)/wire(W) smaller than 1. On the other hand, the rate of the fiber orientation in the lateral direction can be increased to improve the lateral strength of the papers by setting the machine to make jet(J)/wire(W) bigger than 1. At present, the fiber orientation of the papers has been adjusted the above way.

The method of controlling the ratio jet(J)/wire(W) is disclosed in Patent Publications 1 to 3, for instance.

However, in fact, the fiber orientation cannot be controlled in a perfect manner only by setting the parameters of the paper making machines such as the control of the ratio J/W. Since the distribution of the speed in the jet stream causes a turbulence, it has been pointed out that the numerical control of the parameters so as to match target value is technically difficult. In particular, recent rise of environmental consciousness such as the recycle of the old-used material, or the resource saving leads to the usage of the old pulp, etc., whereby the generation of the turbulence becomes a main factor. In addition, since the paper layer is formed on a portion contacting the wire, it has been pointed out that the fiber orientation gradually varies in the thicknesswise direction of the pater to be made. The above these factors are associated with each other in a complicated manner to make the control of the fiber orientation of the papers difficult.

Such being the case, in a process for making papers on a practical basis, the technical problem lies in the fact that the fiber orientation of the papers to be made cannot be controlled in a perfect manner only by setting the parameters of the paper making machines such as the control of the ratio J/W.

Patent Publication 3: Japanese Patent Laid-open Publication 2000-144597

Patent Publication 2: Japanese Patent Laid-open Publication 2001-192992

Patent Publication 1: Japanese Patent Laid-open Publication 2013-213286

DISCLOSURE OF THE INVENTION

Technical Problems to be Solved by Present Invention

Accordingly, the inventor found out the technology in which the fiber orientation of the papers to be made is controlled not by setting the parameters concerning the mechanic properties in the paper making machines, but by the wire configuration. In this connection, the object is set to invent a totally new industrial two-layer fabric which still attains the properties required for the industrial fabric such as the rigidity, the wear resistance, the fiber supportability, and the running stability. The technical problem to be solved by the invention is as follows.

In the invention, the fabric including the warps and the wefts which are widely used is adopted. For instance, the industrial fabric is used for the fabric for making papers, the conveyor belt, the filtering cloth, etc., and the properties of the fabric are required, depending on its applications and the environment in which it is used. Among these, the properties for the fabric for making papers used in the paper making process in which the material is dehydrated, etc. by utilizing the network of the fabric are very severe.

Firstly, the object of the present invention is to provide the industrial two-layer fabric which can make papers to be made with a constant fiber orientation in the lateral direction by providing the difference in height on the contacting surface between the papers to be made and the industrial two-layer fabric.

Secondly the object of the present invention is to provide the industrial two-layer fabric which can make papers to be made with a lateral strength higher than that of the fabric constituted by one kind of the conventional upper surface side yarns structure by overcoming the technical difficulty in the adjustment of the fiber orientation due to the complicated factors such as a turbulence generated in the jet stream, the control of the ration J/W, etc.

Means to Solve Technical Problems

The inventor adopted the following constitution in order to solve the above technical problems.

(1) In the industrial two-layer fabric comprising an upper surface side fabric consisting of upper surface side warps and upper surface side wefts and a lower surface side fabric consisting of lower surface side warps and lower surface side wefts, the upper and lower surface side fabric being bound by foundation binding yarns, all structure portions of the upper surface side warps among a structure constituting said upper surface side fabric are the same, said upper surface side wefts comprises first upper surface side wefts and second upper surface side wefts, structures forming the first upper surface side wefts are different from those forming the second upper surface side wefts.

(2) In the industrial two-layer fabric, the upper surface side fabric constituting said industrial two-layer fabric may form a complete structure of four shafts.

(3) In the industrial two-layer fabric, said first upper surface side wefts and said second upper surface side wefts constituting said upper surface side wefts may be a combination of two structures selected from a structure in which said first upper surface side wefts and said second upper surface side wefts pass below one upper surface side warp to pass above one upper surface side warp adjacent to said one upper surface side warp, a structure in which said first upper surface side wefts and said second upper surface side wefts pass below one upper surface side warp to pass above three upper surface side warps adjacent to said one upper surface side warp, a structure in which said first upper surface side wefts and said second upper surface side wefts pass below two upper surface side warps to pass above two upper surface side warps adjacent to said two upper surface side warp, and a structure in which said first upper surface side wefts and said second upper surface side wefts pass below three upper surface side warps to pass above one upper surface side warp adjacent to said three upper surface side warps.

(4) In the industrial two-layer fabric, the upper surface side fabric constituting said industrial two-layer fabric may form a complete structure of five shafts.

(5) In the industrial two-layer fabric, said first upper surface side wefts and said second upper surface side wefts constituting said upper surface side wefts may be a combination of two structures selected from a structure in which said first upper surface side wefts and said second upper surface side wefts pass below one upper surface side warp to pass above four upper surface side warps adjacent to said one upper surface side warp, a structure in which said first upper surface side wefts and said second upper surface side wefts pass below two upper surface side warps to pass above three upper surface side warps adjacent to said two upper surface side warps, a structure in which said first upper surface side wefts and said second upper surface side wefts pass below three upper surface side warps to pass above two upper surface side warps adjacent to said three upper surface side warps, and a structure in which said first upper surface side wefts and said second upper surface side wefts pass below four upper surface side warps to pass above one upper surface side warp adjacent to said four upper surface side warps.

(6) In the industrial two-layer fabric, the upper surface side fabric constituting said industrial two-layer fabric may form a complete structure of six shafts.

(7) In the industrial two-layer fabric, said first upper surface side wefts and said second upper surface side wefts constituting said upper surface side wefts may be a combination of two structures selected from a structure in which said first upper surface side wefts and said second upper surface side wefts pass below one upper surface side warp to pass above one upper surface side warp adjacent to said one upper surface side warp, a structure in which said first upper surface side wefts and said second upper surface side wefts pass below one upper surface side warp to pass above two upper surface side warps adjacent to said one upper surface side warp, a structure in which said first upper surface side wefts and said second upper surface side wefts pass below one upper surface side warp to pass above five upper surface side warps adjacent to said one upper surface side warps, a structure in which said first upper surface side wefts and said second upper surface side wefts pass below two upper surface side warps to pass above four upper surface side warp adjacent to said two upper surface side warps, a structure in which said first upper surface side wefts and said second upper surface side wefts pass below two upper surface side warps to pass above one upper surface side warp adjacent to said two upper surface side warps, a structure in which said first upper surface side wefts and said second upper surface side wefts pass below three upper surface side warps to pass above three upper surface side warp adjacent to said three upper surface side warps, a structure in which said first upper surface side wefts and said second upper surface side wefts pass below four upper surface side warps to pass above two upper surface side warp adjacent to said four upper surface side warps, a structure in which said first upper surface side wefts and said second upper surface side wefts pass below five upper surface side warps to pass above one upper surface side warp adjacent to said five upper surface side warps.

(8) In the industrial two-layer fabric, said foundation binding yarns may be constituted by warps.

(9) In the industrial two-layer fabric, said foundation binding yarns may be constituted by wefts.

(10) In the industrial two-layer fabric, the structure forming the first upper surface side wefts and the structure forming the second upper surface side wefts which is different from the former structure may be arranged one by one in an alternate manner.

(11) In the industrial two-layer fabric, all of said upper surface side wefts may be formed by yarns with the same diameter.

(12) In the industrial two-layer fabric, the number of a portion of the upper surface side warp passing above the upper surface side weft to form knuckles may be less than that of a portion of the upper surface side warp passing below the upper surface side weft, on the surface if the upper surface side fabric.

Effect of the Invention

According to the industrial two-layer fabric of the present invention, papers to be made with a constant fiber orientation in a lateral direction can be made by providing a difference in height on the contacting surface between the papers to be made and the industrial two-layer fabric.

According to the industrial two-layer fabric of the present invention, papers to be made with a strength in a longitudinal or a lateral direction higher than that of the conventional fabric constituted by one kind of the upper surface side yarn structure can be provided by overcoming the difficulty in the adjustment of the fiber orientation due to complicated factors such as the turbulence generated in the jet stream, the control of the ratio of J/W.

DETAILED DESCRIPTION OF THE INVENTION

Now, the structure and the effect of the two-layer fabric of the present invention will be described below. Embodiments of the two-layer fabric of the present invention will be described thereafter with reference to the drawings.

In this connection, since the following embodiments are examples of the present invention, the scope of the present invention can be beyond the following embodiments.

The two-layer fabric in the following embodiments according to the present invention is constituted by binding the upper surface side fabric consisting of the upper surface side warps and the upper surface side wefts, and the lower surface side fabric consisting of the lower surface side warps and the lower surface side wefts, by means of the binding yarns.

No particular limitation is imposed on a yarn to be used in the present invention and it can be selected freely depending on the properties which an industrial fabric is desired to have. Examples of it include, in addition to monofilaments, multifilaments, spun yarns, finished yarns subjected to crimping or bulking such as so-called textured yarn, bulky yarn and stretch yarn, and yarns obtained by intertwining them. As the cross-section of the yarn, not only circular form but also square or short form such as stellar form, or elliptical or hollow form can be used. The material of the yarn can be selected freely and usable examples of it include polyester, polyamide, polyphenylene sulfide, polyvinylidene fluoride, polypropylene, aramid, polyether ketone, polyethylene naphthalate, polytetrafluoroethylene, cotton, wool and metal. Of course, yarns obtained using copolymers or incorporating or mixing the above-described material with a substance selected depending on the intended purpose may be used.

In the fabric of the present invention, the lower surface side warp serving as the binding yarn binding the upper surface side fabric and the lower surface side fabric by a portion of the lower surface side warps being woven with the upper surface side wefts.

In addition, the diameter of the lower surface side weft may be larger than that of the upper surface side weft. In a case where the diameter of the lower surface side wet is made large, a balance of the two-layer fabric can be improved. Further, the two-layer fabric with a long life can be provided, since the cut of the warps due to the can be decreased by making the diameter of the lower surface side warp large.

Figure 1:
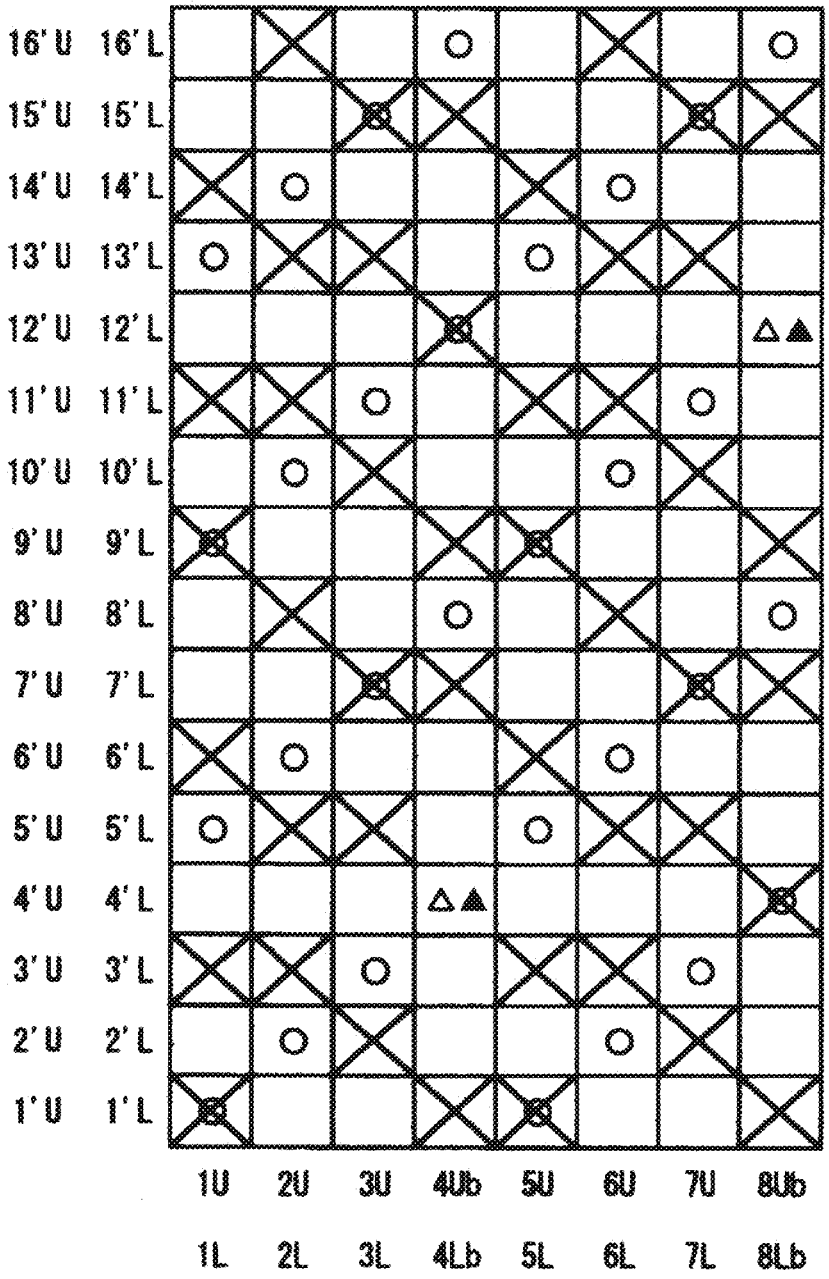
FIG. 1 is a design view showing the industrial two-layer fabric of the first embodiment according to the present invention.
Figure 2:
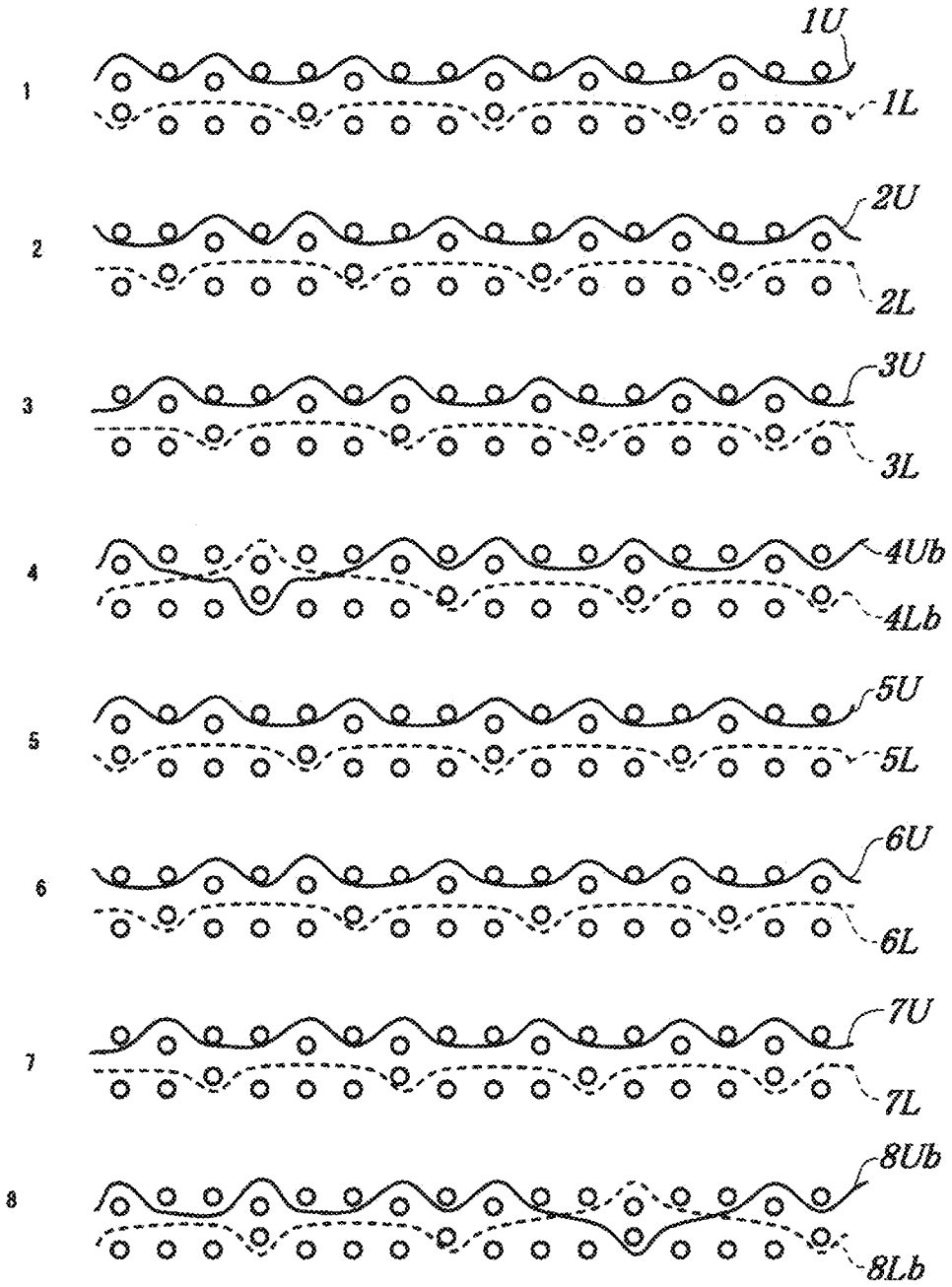
FIG. 2 is a longitudinal cross section view showing the yarn structure of the industrial two-layer fabric of the first embodiment according to the present invention.
Figure 3:
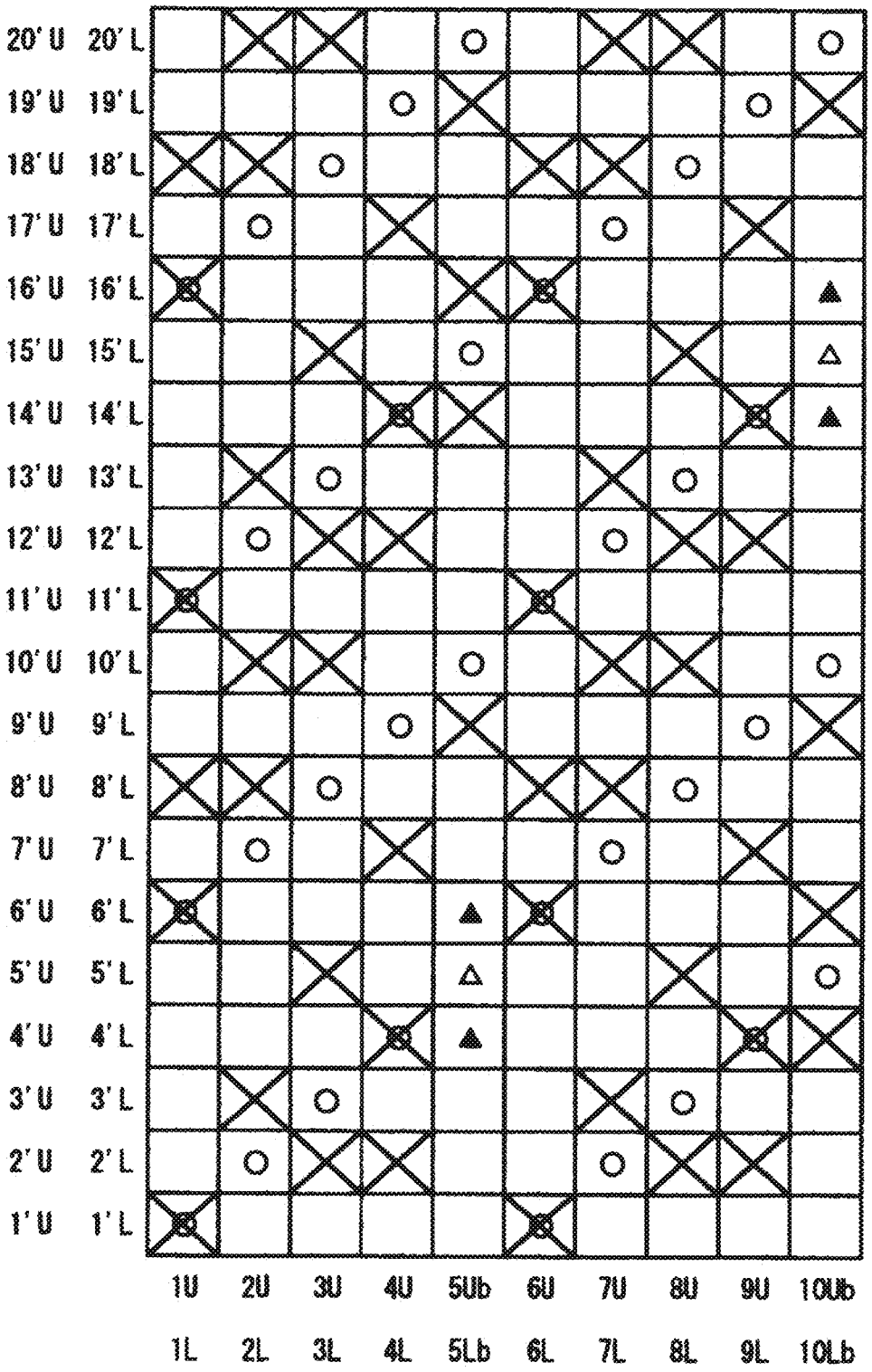
FIG. 3 is a design view showing the industrial two-layer fabric of the second embodiment according to the present invention.
Figure 4:
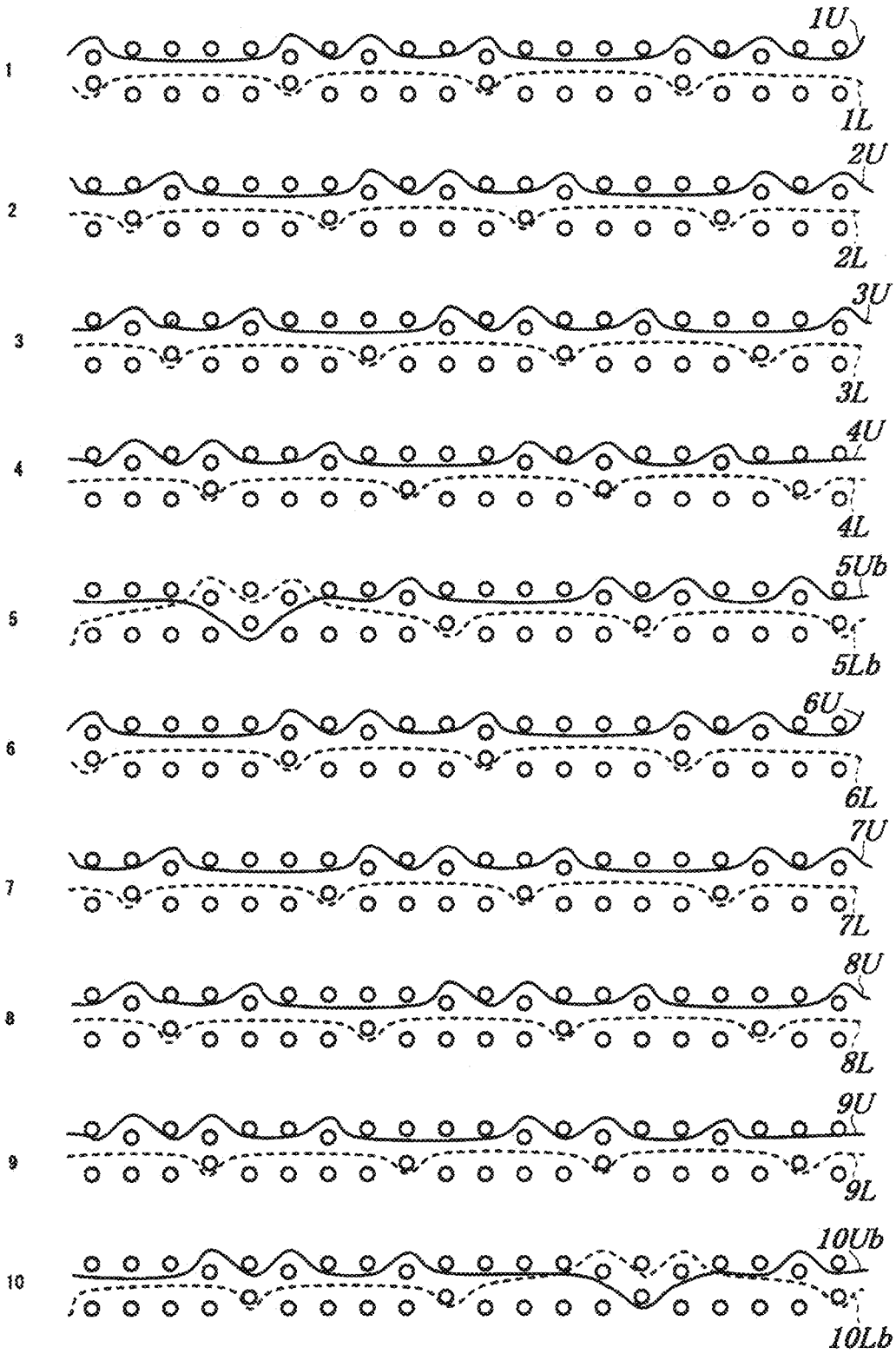
FIG. 4 is a longitudinal cross section view showing the yarn structure of the industrial two-layer fabric of the second embodiment according to the present invention.

Now, the embodiments of the present invention will be described below with reference to the drawings. FIG. 1 is a design view showing a complete structure of a first embodiment of the present invention. FIG. 2 is a longitudinal cross-section view showing the structure of the yarns of the industrial fabric in the first embodiment of the present invention. FIG. 3 is a design view showing the industrial fabric in the second embodiment of the present invention. FIG. 4 is a longitudinal cross-section view showing the structure of the yarns of the industrial fabric in the second embodiment of the present invention. Here, the design view corresponds to the complete structure of the fabric defining the minimum unit to be repeated of the fabric structure. The fabric recited in the claims corresponds to this complete structure. The final product is completed by combining any number of such complete structures in the longitudinal direction and the direction perpendicular to the longitudinal direction.

The longitudinal cross-section view showing the situation in which the warps are woven with each other in a complete structure.

In each of the design views, the warp is indicated by a reference number such as 1, 2, 3 . . . . In addition, the warp binding yarn weaving the upper and lower wefts is indicated by the figure to which b is attached, the upper surface side warp is indicated by the figure to which U is attached, while, the lower surface side warp is indicated by the figure to which L is attached.

In the design view, the warps with the same figure indicate to form a group. For instance, in FIG. 1, the warps U and the lower surface side warps L, and the upper surface side warps U and the lower surface side warp binding yarns Lb form a group, respectively, and, in FIG. 3, the upper surface side warp U and the lower surface side warps L, and the upper surface side warp binding yarns Ub and the lower surface side warp binding yarns Lb form a group, respectively.

The weft is indicated by a reference number such as 1', 2', 3' . . . . A case where the upper surface side wefts and the lower surface side wefts are arranged to be vertically and a case where the upper surface side wefts are arranged to be vertically can occur, in accordance with the ratio of the arrangement of the wefts. The upper surface side wefts and the lower surface side wefts are indicated by the figure to which U is attached and the figure to which L is attached, respectively, 1'U, 1'L, etc., for instance.

In each of the design views, a symbol "×" indicates a portion where the upper surface side weft ('U) passes below the upper surface side warp (U), a triangle symbol "Δ" indicates a portion where the upper surface side weft ('U) passes below the lower surface side warp (Ub) serving as a foundation binding yarn, a solid triangle symbol "▲" indicates a portion where the lower surface side weft (Ub) serving as a foundation binding yarn passes below the lower surface side weft ('L), and a symbol "○" indicates a portion where the lower surface side warp (U) passes below the lower surface side weft.

In addition, in the design views, yarns are shown to be arranged to be vertically, but this is only for the clarity of the drawings. In fact, the real fabric can be arranged to be vertically offset.

First Embodiment

FIGS. 1 and 2 are a design view and a cross section view showing an industrial two-layer fabric according to the first embodiment, respectively.

As shown in FIGS. 1 and 2, the industrial two-layer fabric according to the first embodiment includes upper surface side warps (1U~3U, 5U~7U) and lower surface side warps (1L~3L, 5L~7L), and upper surface side warps (4Ub, 8Ub) and lower surface side warps (4Lb, 8Lb) both serving as foundation binding yarns. A ratio of the upper surface side wefts (1'U, 2'U . . . ) to the lower surface side wefts (1'L, 2'L . . . ) is 1/1.

In addition, as shown in FIGS. 1 and 2, the industrial two-layer fabric according to the first embodiment constitutes a fabric of eight shafts. Further, the industrial two-layer fabric according to the first embodiment is constituted by a minimum structure in a four shafts base.

In the first embodiment, as shown in FIG. 2, the upper surface side warps 1U, 2U, 3U, 5U, 6U, 7U pass above one upper surface side weft and below one upper surface side weft, and pass one upper surface side weft and below two upper surface side wefts, and pass one upper surface side weft and below two upper surface side wefts, and pass one upper surface side weft and below one upper surface side wefts, and pass one upper surface side weft and below two upper surface side wefts, and pass one upper surface side weft and below two upper surface side wefts.

On the other hand, the lower surface side warps 1L, 2L, 3L, 5L, 6L, 7L pass below one lower surface side weft and above three lower surface side wefts, and pass below one lower surface side weft and above three lower surface side wefts, and pass below one lower surface side weft and above three lower surface side wefts, and pass below one lower surface side weft and above three lower surface side wefts.

More specifically, the technical features of the industrial two-layer fabric according to the first embodiment according to the first embodiment lie in the fact that the industrial two-layer fabric is constituted by a combination of a structure in which a first upper surface side weft and a second lower surface side weft constituting an upper surface side wefts pass below one upper surface side warp and above three upper surface side warps adjacent to the one upper surface side warp, with a structure in which a first upper surface side weft and a second lower surface side weft constituting an upper surface side wefts pass below two upper surface side warps and above two upper surface side warps adjacent to the two upper surface side warps.

By adopting the above structures of two kinds of upper surface side wefts, since the structure in which the first upper surface side weft and the second lower surface side weft pass below one upper surface side warp and above upper three upper surface side warps adjacent to the one upper surface side warp floats in a plane form slightly more than the structure in which the first upper surface side weft and the second lower surface side weft pass below two upper surface side warps and above two upper surface side warps adjacent to the two upper surface side warps, a difference in height on the surface of the fabric is caused to generate. Since such a difference in height on the surface of the fabric causes a difference in height on a contacting surface between the industrial fabric and the papers to be made, an excellent effect in which papers to be made with a constant fabric orientation in a lateral direction can be produced can be caused.

Second Embodiment

FIGS. 3 and 4 are a design view and a cross section view showing an industrial two-layer fabric according to the second embodiment, respectively.

As shown in FIGS. 3 and 4, the industrial two-layer fabric according to the second embodiment includes upper surface side warps (1U~4U, 6U~9U) and lower surface side warps (1L~4L, 6L~9L), and upper surface side warps (5Ub, 10Ub) and lower surface side warps (5Lb, 10Lb) both serving as foundation binding yarns. A ratio of the upper surface side wefts (1'U, 2'U . . . ) to the lower surface side wefts (1'L, 2'L . . . ) is 1/1.

In addition, as shown in FIGS. 3 and 4, the industrial two-layer fabric according to the second embodiment constitutes a fabric of ten shafts. Further, the industrial two-layer fabric according to the second embodiment is constituted by a minimum structure in a five shafts base.

In addition, as shown in FIG. 4, the upper surface side warps 1U~4U, 6U~9U pass above one upper surface side weft and below one upper surface side weft, and pass one upper surface side weft and below four upper surface side wefts, and pass one upper surface side weft and below one upper surface side weft, and pass one upper surface side weft and below two upper surface side wefts, and pass one upper surface side weft and below four upper surface side wefts.

On the other hand, the lower surface side warps 1L~4L, 6L~9L pass below one lower surface side weft and above four lower surface side wefts, and pass below one lower surface side weft and above four lower surface side wefts, and pass below one lower surface side weft and above four lower surface side wefts, and pass below one lower surface side weft and above four lower surface side wefts.

More specifically, the technical features of the industrial two-layer fabric according to the second embodiment lie in the fact that the industrial two-layer fabric is constituted by a combination of a structure in which a first upper surface side weft and a second lower surface side weft constituting an upper surface side wefts pass below one upper surface side warp and above four upper surface side warps adjacent to the one upper surface side warp, with a structure in which a first upper surface side weft and a second lower surface side weft constituting an upper surface side wefts pass below two upper surface side warps and above three upper surface side warps adjacent to the two upper surface side warps.

By adopting the above structures of two kinds of upper surface side wefts, since the structure in which the first upper surface side weft and the second lower surface side weft pass below one upper surface side warp and above four upper surface side warps adjacent to the one upper surface side warp floats in a plane form slightly more than the structure in which the first upper surface side weft and the second lower surface side weft pass below two upper surface side warps and above three upper surface side warps adjacent to the two upper surface side warps, a difference in height on the surface of the fabric is caused to generate. Since such a difference in height on the surface of the fabric causes a difference in height on a contacting surface between the industrial fabric and the papers to be made, an excellent effect in which papers to be made with a constant fabric orientation in a lateral direction can be produced can be caused.

Third Embodiment

Figure 5:
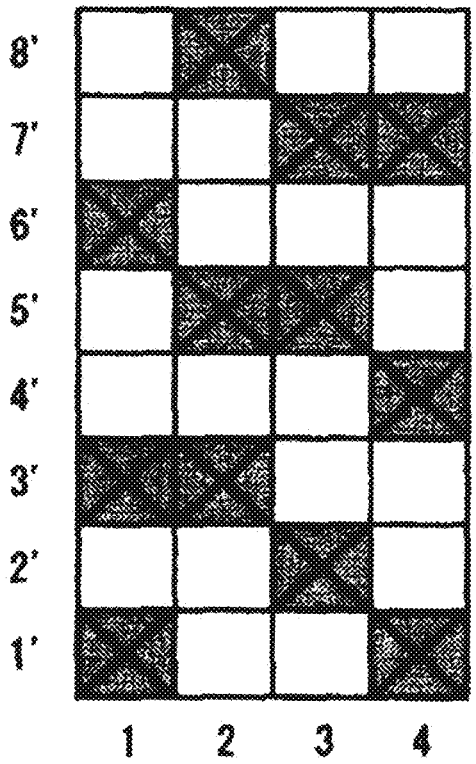
FIG. 5 is a design view showing the upper surface side structure of the industrial two-layer fabric of the third embodiment according to the present invention.

FIG. 5 is a design view and a cross section view showing an industrial two-layer fabric according to the third embodiment.

As shown in FIG. 5, the industrial two-layer fabric according to the third embodiment is constituted by a minimum structure in a four-shafts base.

As shown in FIG. 5, the technical features of the industrial two-layer fabric according to the third embodiment lie in the fact that the industrial two-layer fabric is constituted by a combination of a structure in which a first upper surface side weft and a second lower surface side weft constituting an upper surface side wefts pass below one upper surface side warp and above three upper surface side warps adjacent to the one upper surface side warp, with a structure in which a first upper surface side weft and a second lower surface side weft constituting an upper surface side wefts pass below two upper surface side warps and above two upper surface side warps adjacent to the two upper surface side warps.

By adopting the above structures of two kinds of upper surface side wefts, since the structure in which the first upper surface side weft and the second lower surface side weft pass below one upper surface side warp and above three upper surface side warps adjacent to the one upper surface side warp floats in a plane form slightly more than the structure in which the first upper surface side weft and the second lower surface side weft pass below two upper surface side warps and above two upper surface side warps adjacent to the two upper surface side warps, a difference in height on the surface of the fabric is caused to generate. Since such a difference in height on the surface of the fabric causes a difference in height on a contacting surface between the industrial fabric and the papers to be made, an excellent effect in which papers to be made with a constant fabric orientation in a lateral direction can be produced can be caused.

Fourth Embodiment

Figure 6:
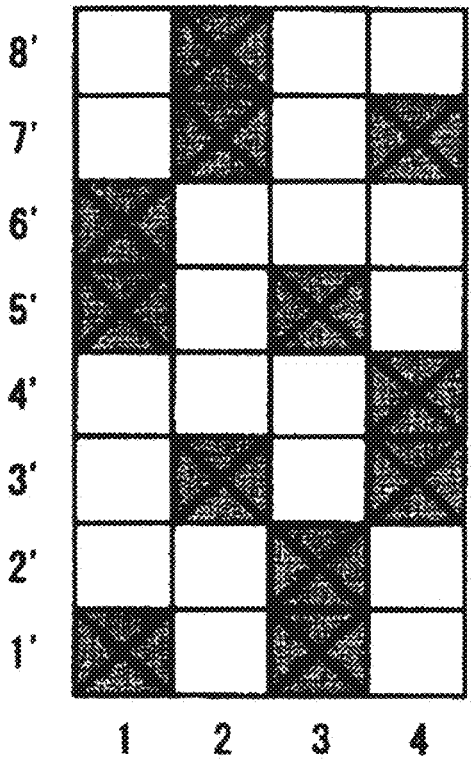
FIG. 6 is a design view showing the upper surface side structure of the industrial two-layer fabric of the fourth embodiment according to the present invention.

FIG. 6 is a design view and a cross section view showing an industrial two-layer fabric according to the fourth embodiment.

As shown in FIG. 6, the industrial two-layer fabric according to the fourth embodiment is constituted by a minimum structure in a four-shafts base.

As shown in FIG. 6, the technical features of the industrial two-layer fabric according to the fourth embodiment lie in the fact that the industrial two-layer fabric is constituted by a combination of a structure in which a first upper surface side weft and a second lower surface side weft constituting an upper surface side wefts pass below one upper surface side warp and above three upper surface side warps adjacent to the one upper surface side warp, with a structure in which a first upper surface side weft and a second lower surface side weft constituting an upper surface side wefts pass below one upper surface side warp and above one upper surface side warp adjacent to the one upper surface side warp.

By adopting the above structures of two kinds of upper surface side wefts, since the structure in which the first upper surface side weft and the second lower surface side weft pass below one upper surface side warp and above three upper surface side warps adjacent to the one upper surface side warp floats in a plane form slightly more than the structure in which the first upper surface side weft and the second lower surface side weft pass below one upper surface side warps and above one upper surface side warp adjacent to the two upper surface side warp, a difference in height on the surface of the fabric is caused to generate. Since such a difference in height on the surface of the fabric causes a difference in height on a contacting surface between the industrial fabric and the papers to be made, an excellent effect in which papers to be made with a constant fabric orientation in a lateral direction can be produced can be caused.

Fifth Embodiment

Figure 7:
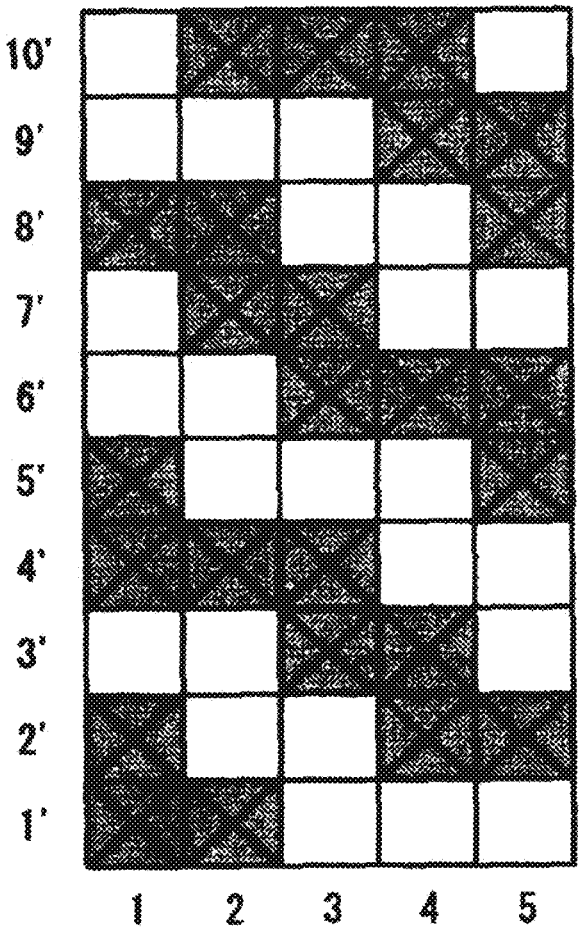
FIG. 7 is a design view showing the upper surface side structure of the industrial two-layer fabric of the fifth embodiment according to the present invention.

FIG. 7 is a design view and a cross section view showing an industrial two-layer fabric according to the fifth embodiment.

As shown in FIG. 7, the industrial two-layer fabric according to the fifth embodiment is constituted by a minimum structure in a five-shafts base.

As shown in FIG. 7, the technical features of the industrial two-layer fabric according to the fifth embodiment lie in the fact that the industrial two-layer fabric is constituted by a combination of a structure in which a first upper surface side weft and a second lower surface side weft constituting an upper surface side wefts pass below two upper surface side warps and above three upper surface side warps adjacent to the two upper surface side warps, with a structure in which a first upper surface side weft and a second lower surface side weft constituting an upper surface side wefts pass below three upper surface side warps and above two upper surface side warps adjacent to the three upper surface side warps.

By adopting the above structures of two kinds of upper surface side wefts, since the structure in which the first upper surface side weft and the second lower surface side weft pass below three upper surface side warp and above two upper surface side warps adjacent to the three upper surface side warp floats in a plane form slightly more than the structure in which the first upper surface side weft and the second lower surface side weft pass below two upper surface side warps and above three upper surface side warps adjacent to the two upper surface side warps, a difference in height on the surface of the fabric is caused to generate. Since such a difference in height on the surface of the fabric causes a difference in height on a contacting surface between the industrial fabric and the papers to be made, an excellent effect in which papers to be made with a constant fabric orientation in a lateral direction can be produced can be caused.

Sixth Embodiment

Figure 8:
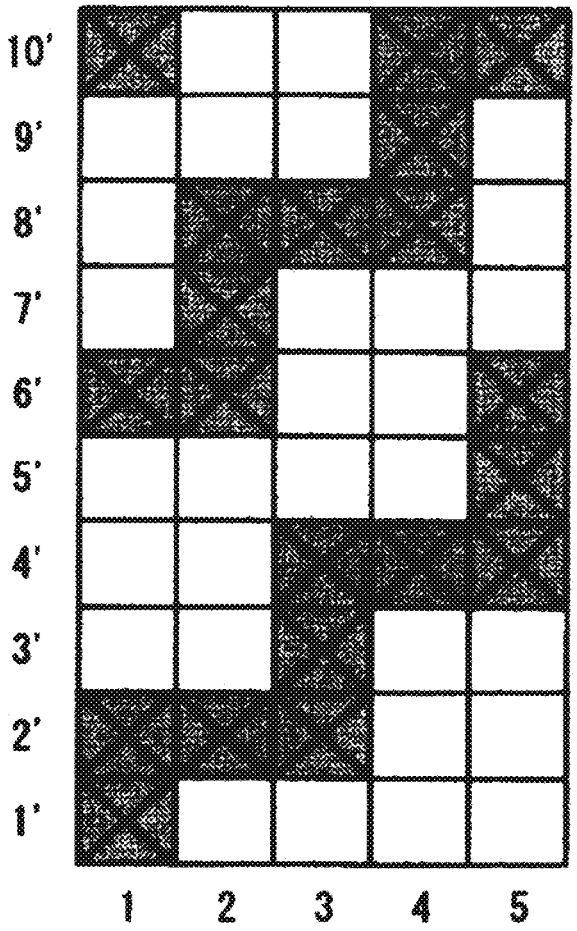
FIG. 8 is a design view showing the upper surface side structure of the industrial two-layer fabric of the sixth embodiment according to the present invention.

FIG. 8 is a design view and a cross section view showing an industrial two-layer fabric according to the sixth embodiment.

As shown in FIG. 7, the industrial two-layer fabric according to the fifth embodiment is constituted by a minimum structure in a five-shafts base.

As shown in FIG. 8, the technical features of the industrial two-layer fabric according to the sixth embodiment lie in the fact that the industrial two-layer fabric is constituted by a combination of a structure in which a first upper surface side weft and a second lower surface side weft constituting an upper surface side wefts pass below one upper surface side warps and above four upper surface side warps adjacent to the one upper surface side warp, with a structure in which a first upper surface side weft and a second lower surface side weft constituting an upper surface side wefts pass below three upper surface side warps and above two upper surface side warps adjacent to the three upper surface side warps.

By adopting the above structures of two kinds of upper surface side wefts, since the structure in which the first upper surface side weft and the second lower surface side weft pass below one upper surface side warp and above four upper surface side warps adjacent to the one upper surface side warp floats in a plane form slightly more than the structure in which the first upper surface side weft and the second lower surface side weft pass below three upper surface side warps and above two upper surface side warps adjacent to the three upper surface side warps, a difference in height on the surface of the fabric is caused to generate. Since such a difference in height on the surface of the fabric causes a difference in height on a contacting surface between the industrial fabric and the papers to be made, an excellent effect in which papers to be made with a constant fabric orientation in a lateral direction can be produced can be caused.

Seventh Embodiment

Figure 9:
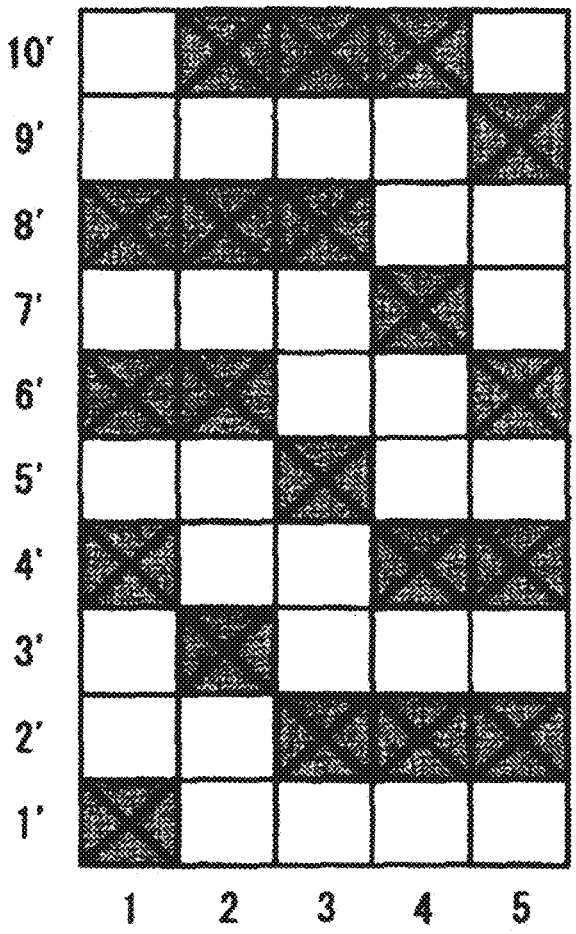
FIG. 9 is a design view showing the upper surface side structure of the industrial two-layer fabric of the seventh embodiment according to the present invention.

FIG. 9 is a design view and a cross section view showing an industrial two-layer fabric according to the seventh embodiment.

As shown in FIG. 9, the industrial two-layer fabric according to the seventh embodiment is constituted by a minimum structure in a five-shafts base.

As shown in FIG. 9, the technical features of the industrial two-layer fabric according to the seventh embodiment lie in the fact that the industrial two-layer fabric is constituted by a combination of a structure in which a first upper surface side weft and a second lower surface side weft constituting an upper surface side wefts pass below one upper surface side warps and above four upper surface side warps adjacent to the one upper surface side warp, with a structure in which a first upper surface side weft and a second lower surface side weft constituting an upper surface side wefts pass below three upper surface side warps and above two upper surface side warps adjacent to the three upper surface side warps.

By adopting the above structures of two kinds of upper surface side wefts, since the structure in which the first upper surface side weft and the second lower surface side weft pass below one upper surface side warp and above four upper surface side warps adjacent to the one upper surface side warp floats in a plane form slightly more than the structure in which the first upper surface side weft and the second lower surface side weft pass below three upper surface side warps and above two upper surface side warps adjacent to the three upper surface side warps, a difference in height on the surface of the fabric is caused to generate. Since such a difference in height on the surface of the fabric causes a difference in height on a contacting surface between the industrial fabric and the papers to be made, an excellent effect in which papers to be made with a constant fabric orientation in a lateral direction can be produced can be caused.

Eighth Embodiment

Figure 10:
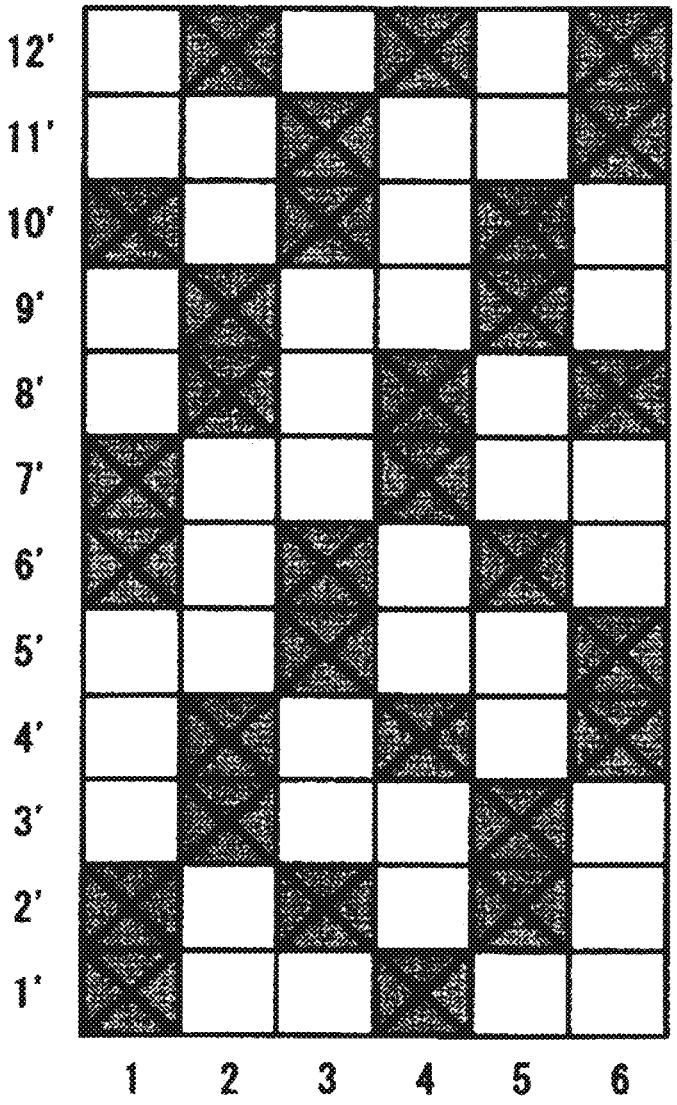
FIG. 10 is a design view showing the upper surface side structure of the industrial two-layer fabric of the eighth embodiment according to the present invention.

FIG. 10 is a design view and a cross section view showing an industrial two-layer fabric according to the eighth embodiment.

As shown in FIG. 10, the industrial two-layer fabric according to the eighth embodiment is constituted by a minimum structure in a six-shafts base.

As shown in FIG. 10, the technical features of the industrial two-layer fabric according to the eighth embodiment lie in the fact that the industrial two-layer fabric is constituted by a combination of a structure in which a first upper surface side weft and a second lower surface side weft constituting an upper surface side wefts pass below one upper surface side warps and above two upper surface side warps adjacent to the one upper surface side warp, with a structure in which a first upper surface side weft and a second lower surface side weft constituting an upper surface side wefts pass below one upper surface side warp and above one upper surface side warp adjacent to the one upper surface side warp.

By adopting the above structures of two kinds of upper surface side wefts, since the structure in which the first upper surface side weft and the second lower surface side weft pass below one upper surface side warp and above two upper surface side warps adjacent to the one upper surface side warp floats in a plane form slightly more than the structure in which the first upper surface side weft and the second lower surface side weft pass below one upper surface side warps and above one upper surface side warps adjacent to the one upper surface side warp, a difference in height on the surface of the fabric is caused to generate. Since such a difference in height on the surface of the fabric causes a difference in height on a contacting surface between the industrial fabric and the papers to be made, an excellent effect in which papers to be made with a constant fabric orientation in a lateral direction can be produced can be caused.

Ninth Embodiment

Figure 11:
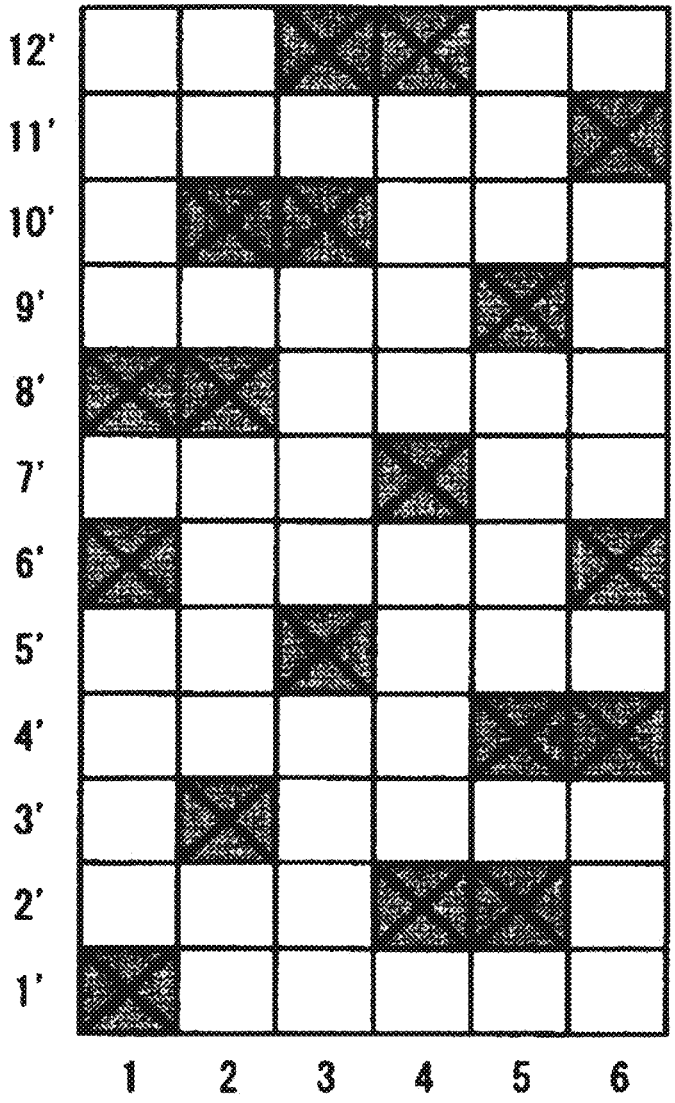
FIG. 11 is a design view showing the upper surface side structure of the industrial two-layer fabric of the ninth embodiment according to the present invention.

FIG. 11 is a design view and a cross section view showing an industrial two-layer fabric according to the ninth embodiment.

As shown in FIG. 11, the industrial two-layer fabric according to the ninth embodiment is constituted by a minimum structure in a six-shafts base.

As shown in FIG. 11, the technical features of the industrial two-layer fabric according to the ninth embodiment lie in the fact that the industrial two-layer fabric is constituted by a combination of a structure in which a first upper surface side weft and a second lower surface side weft constituting an upper surface side wefts pass below one upper surface side warps and above five upper surface side warps adjacent to the one upper surface side warp, with a structure in which a first upper surface side weft and a second lower surface side weft constituting an upper surface side wefts pass below two upper surface side warps and above four upper surface side warps adjacent to the two upper surface side warps.

By adopting the above structures of two kinds of upper surface side wefts, since the structure in which the first upper surface side weft and the second lower surface side weft pass below one upper surface side warp and above five upper surface side warps adjacent to the one upper surface side warp floats in a plane form slightly more than the structure in which the first upper surface side weft and the second lower surface side weft pass below two upper surface side warps and above four upper surface side warps adjacent to the two upper surface side warps, a difference in height on the surface of the fabric is caused to generate. Since such a difference in height on the surface of the fabric causes a difference in height on a contacting surface between the industrial fabric and the papers to be made, an excellent effect in which papers to be made with a constant fabric orientation in a lateral direction can be produced can be caused.

U: upper surface side warp

L: lower surface side warp

'U: upper surface side weft

'L: lower surface side weft

Ub: upper surface side warp serving as foundation binding yarn

Lb: lower surface side warp serving as foundation binding yarn

Lb: lower surface side warp serving as foundation binding yarn

What is claimed is:

1. An industrial two-layer fabric comprising:

an upper surface side fabric comprising upper surface side warps and upper surface side wefts; and a lower surface side fabric comprising lower surface side warps and lower surface side wefts; wherein, the upper surface side fabric and the lower surface side fabric being bound by warp binding yarns, the upper surface side warps include the warp binding yarns and non-binding upper surface side warps that are woven with the upper surface side wefts only;

said upper surface side wefts consist of first upper surface side wefts and second upper surface side wefts, each of the first upper surface side wefts forms a first weaving design structure in a minimum repeated unit, each of the second upper surface side wefts forms a second weaving design structure in the minimum repeated unit, the first weaving design structure is different from the second weaving design structure;

a number of the upper surface side wefts in the minimum repeated unit where each of the upper surface side warps that include the non-binding upper surface side warps passing above the upper surface side wefts to form knuckles is less than a number of the upper surface side wefts in the minimum repeated unit where each of the non-binding upper surface side warps passing below the upper surface side wefts.

2. The industrial two-layer fabric according to claim 1, the minimum repeated unit is a four shaft unit which includes four upper surface side warps.

3. The industrial two-layer fabric according to claim 2, the four upper surface side warps of the four shaft unit consist of a first upper surface side warp, a second upper surface side warp arranged adjacent to the first upper surface side warp, a third upper surface side warp arranged adjacent to the second upper surface side warp and a fourth upper surface side warp arranged adjacent to the third upper surface side warp;

said first upper surface side wefts and said second upper surface side wefts constituting one weaving design structure selected from the group consisting of:

(1) a structure in which said first upper surface side wefts or said second upper surface side wefts pass below the first upper surface side warp, pass above the second upper surface side warp, pass below the third upper surface side warp and pass above the fourth upper surface side warp;

(2) a structure in which said first upper surface side wefts or said second upper surface side wefts pass below the first upper surface side warp, and pass above the second, the third and the fourth upper surface side warps;

(3) a structure in which said first upper surface side wefts or said second upper surface side wefts pass below the first and the second upper surface side warps and pass above the third and fourth upper surface side warps; and (4) a structure in which said first upper surface side wefts or said second upper surface side wefts pass below the first, the second and the third upper surface side warps and pass above the fourth upper surface side warp.

4. The industrial two-layer fabric according to claim 1, the minimum repeated unit structure is a five shaft unit which includes five upper surface side warps.

5. The industrial two-layer fabric according to claim 4, the five upper surface side warps of the five shaft unit consist of a first upper surface side warp, a second upper surface side warp arranged adjacent to the first upper surface side warp, a third upper surface side warp arranged adjacent to the second upper surface side warp, a fourth upper surface side warp arranged adjacent to the third upper surface side warp and a fifth upper surface side warp arranged adjacent to the fourth upper surface side warp;

said first upper surface side wefts and said second upper surface side wefts constituting one weaving design structure selected from the group consisting of:

(1) a structure in which said first upper surface side wefts or said second upper surface side wefts pass below the first upper surface side warp, and pass above the second, the third, the fourth and the fifth upper surface side warps;

(2) a structure in which said first upper surface side wefts or said second upper surface side wefts pass below the first and the second upper surface side warps and pass above the third, the fourth and the fifth upper surface side warps;

(3) a structure in which said first upper surface side wefts or said second upper surface side wefts pass below the first, the second and the third upper surface side warps and pass above the fourth and the fifth upper surface side warps; and (4) a structure in which said first upper surface side wefts or said second upper surface side wefts pass below the first, the second, the third and the fourth upper surface side warps and pass above the fifth upper surface side warp.

6. The industrial two-layer fabric according to claim 1, the minimum repeated unit is a six shaft unit which includes six upper surface side warps.

7. The industrial two-layer fabric according to claim 6, the six upper surface side warps of the six shaft unit consists of a first upper surface side warp, a second upper surface side warp arranged adjacent to the first upper surface side warp, a third upper surface side warp arranged adjacent to the second upper surface side warp, a fourth upper surface side warp arranged adjacent to the third upper surface side warp, a fifth upper surface side warp arranged adjacent to the fourth upper surface side warp and a sixth upper surface side warp arranged adjacent to the fifth upper surface side warp;

said first upper surface side wefts and said second upper surface side wefts constituting one weaving design structure selected from the group consisting of:

(1) a structure in which said first upper surface side wefts or said second upper surface side wefts pass below the first upper surface side warp, pass above the second upper surface side warp, pass below the third upper surface side warp, pass above the fourth upper surface side warp, pass below the fifth upper surface side warp and pass above the sixth upper surface side warp;

(2) a structure in which said first upper surface side wefts or said second upper surface side wefts pass below the first upper surface side warp, pass above the second and third upper surface side warps, pass below the fourth upper surface side warp and pass above the fifth and sixth upper surface side warps;

(3) a structure in which said first upper surface side wefts or said second upper surface side wefts pass below the first upper surface side warp and pass above the second, the third, the fourth, the fifth and the sixth upper surface side warps;

(4) a structure in which said first upper surface side wefts or said second upper surface side wefts pass below the first and second upper surface side warps and pass above the third, the fourth, the fifth and the sixth upper surface side warps;

(5) a structure in which said first upper surface side wefts or said second upper surface side wefts pass below the first and the second upper surface side warps, pass above the third upper surface side warp, pass below the fourth and the fifth upper surface side warps and pass below the sixth upper surface side warp;

(6) a structure in which said first upper surface side wefts or said second upper surface side wefts pass below the first, the second and the third upper surface side warps and pass above the fourth, the fifth and the sixth upper surface side warps;

(7) a structure in which said first upper surface side wefts or said second upper surface side wefts pass below the first, the second, the third and the fourth upper surface side warps and pass above the fifth and the sixth upper surface side warp warps; and (8) a structure in which said first upper surface side wefts or said second upper surface side wefts pass below the first, the second, the third, the fourth and the fifth upper surface side warps and pass above the sixth upper surface side warp.

8. The industrial two-layer fabric according to claim 1, each of the first upper surface side wefts and each of the second upper surface side wefts are arranged in an alternate manner.

9. The industrial two-layer fabric according to claim 1, all of said upper surface side wefts are formed by yarns with the same diameter.

10. The industrial two-layer fabric according to claim 1, a number of the upper surface side wefts in the minimum repeated unit where the upper surface side warp passing above the upper surface side weft to form knuckles is less than a number of the upper surface side wefts in the minimum repeated unit where the upper surface side warp passing below the upper surface side weft.

11. The industrial two-layer fabric according to claim 3, said first weaving design structure is selected from the group consisting of:

(1) a structure in which said first upper surface side wefts or said second upper surface side wefts pass below the first upper surface side warp, pass above the second upper surface side warp, pass below the third upper surface side warp and pass above the fourth upper surface side warp; and (3) a structure in which said first upper surface side wefts or said second upper surface side wefts pass below the first and the second upper surface side warps and pass above the third and the fourth upper surface side warps; and said second weaving design structure is selected from the group consisting of:

(2) a structure in which said first upper surface side wefts or said second upper surface side wefts pass below the first upper surface side warp, pass above the second, the third and the fourth upper surface side warps; and (4) a structure in which said first upper surface side wefts or said second upper surface side wefts pass below the first, the second and the third upper surface side warps and pass above the fourth upper surface side warp.

12. The industrial two-layer fabric according to claim 3, said first weaving design structure constituting (2) a weaving design structure in which said first upper surface side wefts or said second upper surface side wefts pass below the first upper surface side warp, and pass above the second, the third and the fourth upper surface side warps; and said second weaving design structure is selected from the group consisting of:

(3) a structure in which said first upper surface side wefts or said second upper surface side wefts pass below the first and the second upper surface side warps and pass above the third and the fourth upper surface side warps; and (4) a structure in which said first upper surface side wefts or said second upper surface side wefts pass below the first, the second and the third upper surface side warps and pass above the fourth upper surface side warp.

13. The industrial two-layer fabric according to claim 5, each of the first upper surface side wefts and each of the second upper surface side wefts are arranged in an alternate manner.

14. The industrial two-layer fabric according to claim 7, each of the first upper surface side wefts and each of the second upper surface side wefts are arranged in an alternate manner.

15. The industrial two-layer fabric according to claim 11, each of the first upper surface side wefts and each of the second upper surface side wefts are arranged in an alternate manner.

16. The industrial two-layer fabric according to claim 12, each of the first upper surface side wefts and each of the second upper surface side wefts are arranged in an alternate manner.

* * * * *